US006806860B2

(12) United States Patent
Saito et al.

(10) Patent No.: US 6,806,860 B2
(45) Date of Patent: Oct. 19, 2004

(54) LIQUID CRYSTAL DRIVING CIRCUIT AND LOAD DRIVING CIRCUIT

(75) Inventors: Tetsuya Saito, Yokohama (JP); Hironori Minamizaki, Kawasaki (JP); Tetsuro Itakura, Tokyo-to (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 419 days.

(21) Appl. No.: 09/964,465

(22) Filed: Sep. 28, 2001

(65) Prior Publication Data

US 2002/0039090 A1 Apr. 4, 2002

(30) Foreign Application Priority Data

Sep. 29, 2000 (JP) ..... 2000-300491

(51) Int. Cl.[7] ..... G09G 3/36
(52) U.S. Cl. ..... 345/98; 345/89; 345/99
(58) Field of Search ..... 345/87, 89, 94, 345/98, 99, 100, 690, 211, 212, 213

(56) References Cited

U.S. PATENT DOCUMENTS 5,363,118 A * 11/1994 Okumura ..... 345/95
5,796,379 A * 8/1998 Enomoto et al. ..... 345/89
5,999,158 A * 12/1999 Sekido et al. ..... 345/98
6,014,122 A * 1/2000 Hashimoto ..... 345/98
6,313,830 B1 * 11/2001 Yusa ..... 345/204
6,407,729 B1 * 6/2002 Moon ..... 345/99

FOREIGN PATENT DOCUMENTS

JP 8-313867 11/1996
JP 10326084 12/1998

* cited by examiner

*Primary Examiner*—Kent Chang
(74) *Attorney, Agent, or Firm*—Oblon, Spivak, McClelland, Maier & Neustadt, P.C.

(57) ABSTRACT

There is disclosed a liquid crystal driving circuit configured to supply an analog voltage in accordance with digital grayscale data to each of a plurality of signal lines, said circuit comprising: a reference voltage generation circuit configured to output analog reference voltages corresponding to each of said digital grayscale data; a plurality of buffer amplifiers configured to individually perform buffering of said respective analog reference voltages; a grayscale mode circuit configured to determine a grayscale number of said digital grayscale data based on a grayscale mode signal supplied from the outside; and an amplifier enable circuit configured to set each of said plurality of buffer amplifiers to an enable state or a disable state based on an output signal of said grayscale mode circuit.

7 Claims, 11 Drawing Sheets

LIQUID CRYSTAL DRIVING CIRCUIT AND LOAD DRIVING CIRCUIT

CROSS REFERENCE TO RELATED APPLICATIONS

This application is based upon and claims the benefit of priority from the prior Japanese Patent Applications No. 2000-300491, filed on Sep. 29, 2000, the entire contents of which are incorporated herein by reference.

BACKGROUND OF THE INVENTION

1. Field of the Invention

The present invention relates to a liquid crystal driving circuit in which grayscale display is possible, and a load driving circuit for selectively driving a capacitive load.

2. Related Background Art

Since there is only a limited space in a cellular phone, a large-capacitance battery cannot be mounted, and power consumption of a circuit in the phone needs to be reduced as much as possible. On the other hand, a cellular phone having a color liquid crystal panel has increased.

A conventional source driver IC for driving a liquid crystal panel has a buffer amplifier for each signal line in the panel. Therefore, the source driver IC having m pieces of driving output terminals always operate m (e.g., 384 or 420) pieces of buffer amplifiers, thereby increasing the power consumption.

FIG. 11 is a block diagram showing a schematic configuration of this type of conventional signal line driving circuit. The signal line driving circuit of FIG. 11 includes: a shift register 1 for successively shifting a shift pulse supplied from the outside in synchronization with a transfer clock; a plurality of data latch circuits 2 for latching digital grayscale data in synchronization with the shift pulse outputted from each output terminal of the shift register 1; a load latch circuit 3 for latching outputs of the plurality of data latch circuits 2 at the same timing; a level shifter 4 for converting a level of an output of the load latch circuit 3; a D/A converter 5 for outputting an analog voltage in accordance with an output of the level shifter 4; a buffer amplifier 6 for buffering an output of the D/A converter 5; and a breeder 7 for generating an analog reference voltage corresponding to the digital grayscale data. Each output of the buffer amplifier 6 is supplied to each signal line.

Briefly, the breeder 7 divides an external voltage between two power supply voltage (Vcc and GND) by a plurality of resistors connected in series and generates the analog reference voltage.

In the conventional signal line driving circuit shown in FIG. 11, as one method for solving a problem that the power consumption increases, there is proposed a method of disposing the buffer amplifier for each reference voltage line for supplying the analog reference voltage, instead of disposing the buffer amplifier for each signal line. In this case, when the number of grayscales is n, $2^n$ pieces of buffer amplifiers may be disposed. As compared with the buffer amplifiers disposed for the respective signal lines, the number of buffer amplifiers can largely be reduced, and the power consumption can be reduced.

FIG. 12 is a block diagram of a display apparatus disclosed in Japanese Patent Application Laid-Open No. 326084/1998, in which the buffer amplifier is disposed for each reference voltage line. The display apparatus of FIG. 12 includes switches $SW_{10}$ to $SW_{25}$ for switching whether or not to operate each buffer amplifier, and a grayscale conversion/buffer control circuit 71 for selecting a grayscale number in accordance with an input image signal. The number of buffer amplifiers to be operated is changed in accordance with the selected grayscale number, thereby reducing the power consumption.

However, since the display apparatus of FIG. 12 always selects the grayscale number in accordance with the input image signal, a processing burden in the grayscale conversion/buffer control circuit 71 increases. Particularly, when the input image signal frequently changes, e.g. a moving picture, the power consumption of the grayscale conversion/buffer control circuit 71 possibly increases. Moreover, a memory for storing at least one frame of input image signals is necessary, and it is difficult to miniaturize the circuit. Furthermore, the display apparatus of FIG. 12 converts the inputted analog image signal by an A/D converter 72, and then carries out the processing in the grayscale conversion/buffer control circuit 71. Therefore, a high-precision A/D converter is required, thereby increasing a component cost.

For example, when the cellular phone is in a waiting state, only minimum information such as a character is preferably displayed to suppress the power consumption as much as possible. However, when the display apparatus of FIG. 12 is used for the cellular phone, the power consumption of the grayscale conversion/buffer control circuit 71 does not decrease even in the waiting state, and as a result, a waiting time is shortened.

When the buffer amplifier 6 is disposed for each reference voltage line for supplying the analog reference voltage as shown in FIG. 11, it is general to constitute the buffer amplifier 6 by an operational amplifier 11 including two gain stages. Moreover, to improve stability, as shown in FIG. 13A, an output terminal of the output gain stage 11 is fed back to an input terminal via a capacitor element $C_{10}$, and a phase margin is secured by Miller compensation. Alternatively, as shown in a circuit of FIG. 14A proposed in Japanese Patent Application Laid-Open No. 150427/1999, the phase margin is secured by performing phase compensation using a zero obtained by a resistance Rz and load capacitance $C_L$ connected in series to the output.

In the circuit of FIG. 13A, a second pole appearing in an open loop frequency characteristic depends on a frequency $gm_2/C_L$ determined by a transconductance $gm_2$ of a second gain stage and the load capacitance $C_L$ as shown in a frequency characteristic diagram of FIG. 13B. Additionally, a phase rotates by 90 degrees per pole.

In the circuit of FIG. 13A, the larger the load capacitance becomes, the lower the frequency of the second pole becomes, i.e. $gm_2/(m \cdot C_L)$, in accordance with the number m of loads to be driven. Therefore, even in case of a small load capacitance, the phase margin is reduced in driving m (m>>1) loads. When m is larger, there is a problem that the phase margin is further reduced, and oscillation easily occurs.

On the other hand, in the circuit of FIG. 14A, as shown in a frequency characteristic diagram of FIG. 14B, even when a load amount changes, the frequency of the second pole does not move. However, the frequencies of the first pole and the zero change in accordance with the load amount. Moreover, in the circuit of FIG. 14A, as the number of loads increases, a waveform becomes more dull and a settling time becomes longer by a low pass characteristic due to the resistance Rz and load capacitance $m \cdot C_L$.

SUMMARY OF THE INVENTION

According to the present invention, there is provided a liquid crystal driving circuit configured to supply an analog voltage in accordance with digital grayscale data to each of a plurality of signal lines, said circuit comprising:

a reference voltage generation circuit configured to output analog reference voltages corresponding to each of said digital grayscale data;

a plurality of buffer amplifiers configured to individually perform buffering of said respective analog reference voltages;

a grayscale mode circuit configured to determine a grayscale number of said digital grayscale data based on a grayscale mode signal supplied from the outside; and an amplifier enable circuit configured to set each of said plurality of buffer amplifiers to an enable state or a disable state based on an output signal of said grayscale mode circuit.

Moreover, according to the present invention, there is provided a liquid crystal driving circuit configured to supply an analog voltage in accordance with digital grayscale data to each of a plurality of signal lines, said circuit comprising:

a reference voltage generation circuit configured to output analog reference voltages corresponding to each of said digital grayscale data;

a plurality of buffer amplifiers configured to individually perform buffering of said respective analog reference voltages;

a grayscale data use judgment circuit configured to check grayscale inputted at least once or more based on said digital grayscale data inputted within a predetermined period; and an amplifier enable circuit configured to set each of said plurality of buffer amplifiers to an enable state or a disable state based on an output of said grayscale data use judgment circuit.

Furthermore, according to the present invention, there is provided a liquid crystal driving circuit configured to supply an analog voltage in accordance with digital grayscale data to each of a plurality of signal lines, said circuit comprising:

a reference voltage generation circuit configured to output an analog reference voltage corresponding to each of said digital grayscale data;

a shift register configured to output a shift pulse obtained by successively shifting a pulse signal;

a plurality of first latch circuits configured to latch said digital grayscale data in synchronization with the shift pulse outputted from each output terminal of said shift register;

a second latch circuit configured to latch respective outputs of said plurality of first latch circuits substantially at the same timing;

a decoder configured to generate a decode signal based on an output of said second latch circuit;

an output selection circuit configured to output a desired analog voltage for each of said plurality of signal lines based on an output of said decoder; and a grayscale mode circuit configured to determine a grayscale number of said digital grayscale data based on a grayscale mode signal supplied from the outside, wherein each of said first latch circuits comprises at least latch sections corresponding to a maximum grayscale number, and the number of said latch sections brought to an enable state is set to be variable based on an output signal of said grayscale mode signal.

Additionally, there is provided a load driving circuit configured to selectively drive m (m being an integer of 1 or more) pieces of loads based on an output of an operational amplifier, said circuit comprising:

a switch configured to switch whether or not a connection path between each of said loads and said operational amplifier is to be cut; and impedance elements connected to respective paths extended to said m pieces of loads from an output terminal of said operational amplifier through said switch.

Moreover, there is provided a load driving circuit configured to selectively drive m (m being an integer of 1 or more) pieces of loads based on an output of an operational amplifier, said circuit comprising:

a switch configured to switch whether or not a connection path between each of said loads and said operational amplifier is to be interrupted;

impedance elements connected to respective paths extended to said m pieces of loads from an output terminal of said operational amplifier through said switch; and a pseudo impedance element, a pseudo switch and a pseudo capacitor element connected in series to the output terminal of said operational amplifier, wherein a product of an impedance of said pseudo impedance element and a capacitance of said pseudo capacitor element is almost equal to a product of the impedance of said impedance element and the capacitance of said load.

DESCRIPTION OF THE PREFERRED EMBODIMENTS

A liquid crystal driving circuit and load driving circuit according to the present invention will be described hereinafter in detail with reference to the drawings.

First Embodiment

Figure 1:
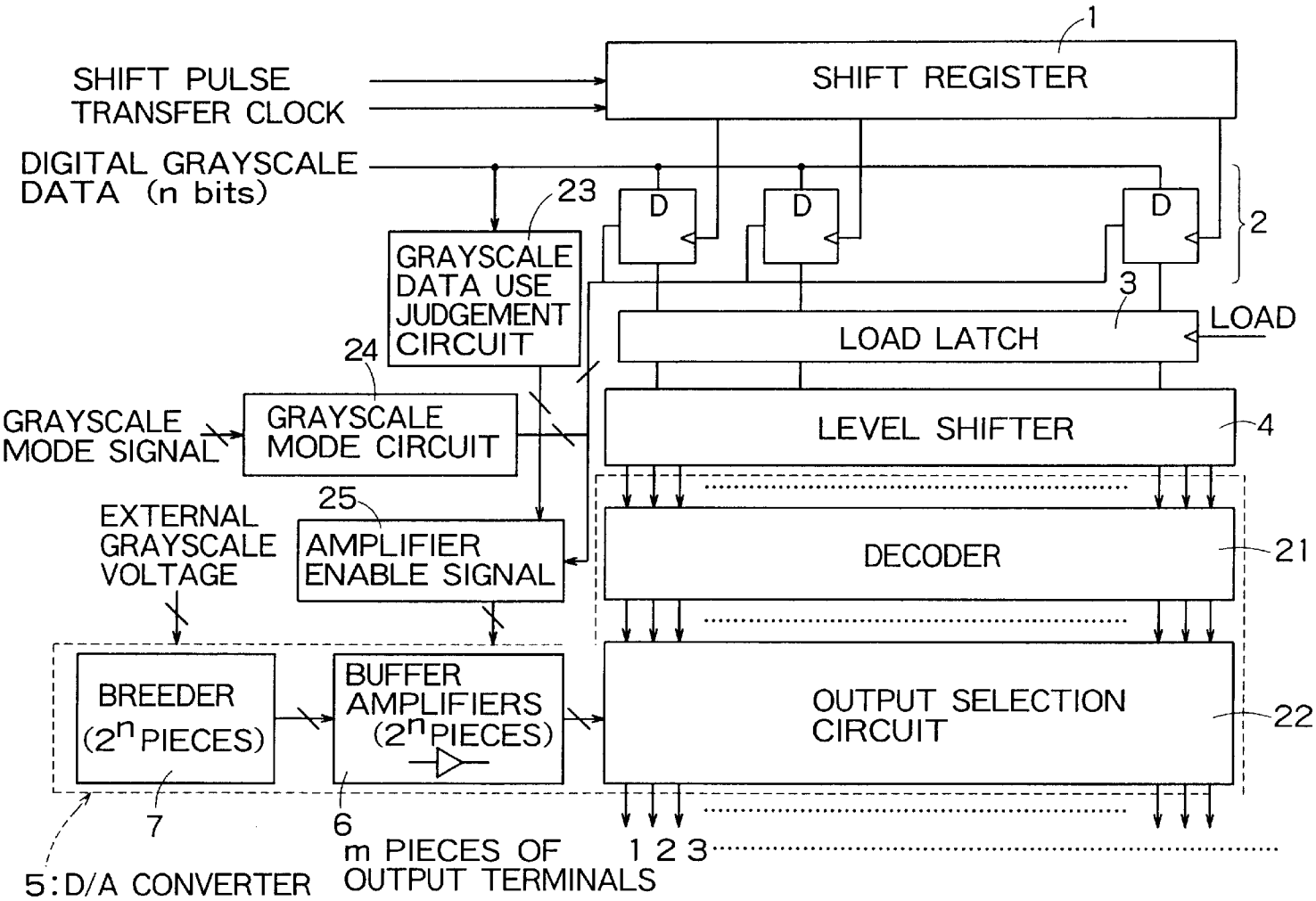
FIG. 1 is a block diagram showing a schematic configuration of one embodiment of a liquid crystal driving circuit according to the present invention.

FIG. 1 is a block diagram showing a schematic configuration of a first embodiment of the liquid crystal driving circuit according to the present invention, and shows a configuration of a signal line driving section. In FIG. 1, constituents common to those of FIG. 11 are denoted with the same reference numerals, and mainly a different respect will be described hereinafter.

Figure 11:
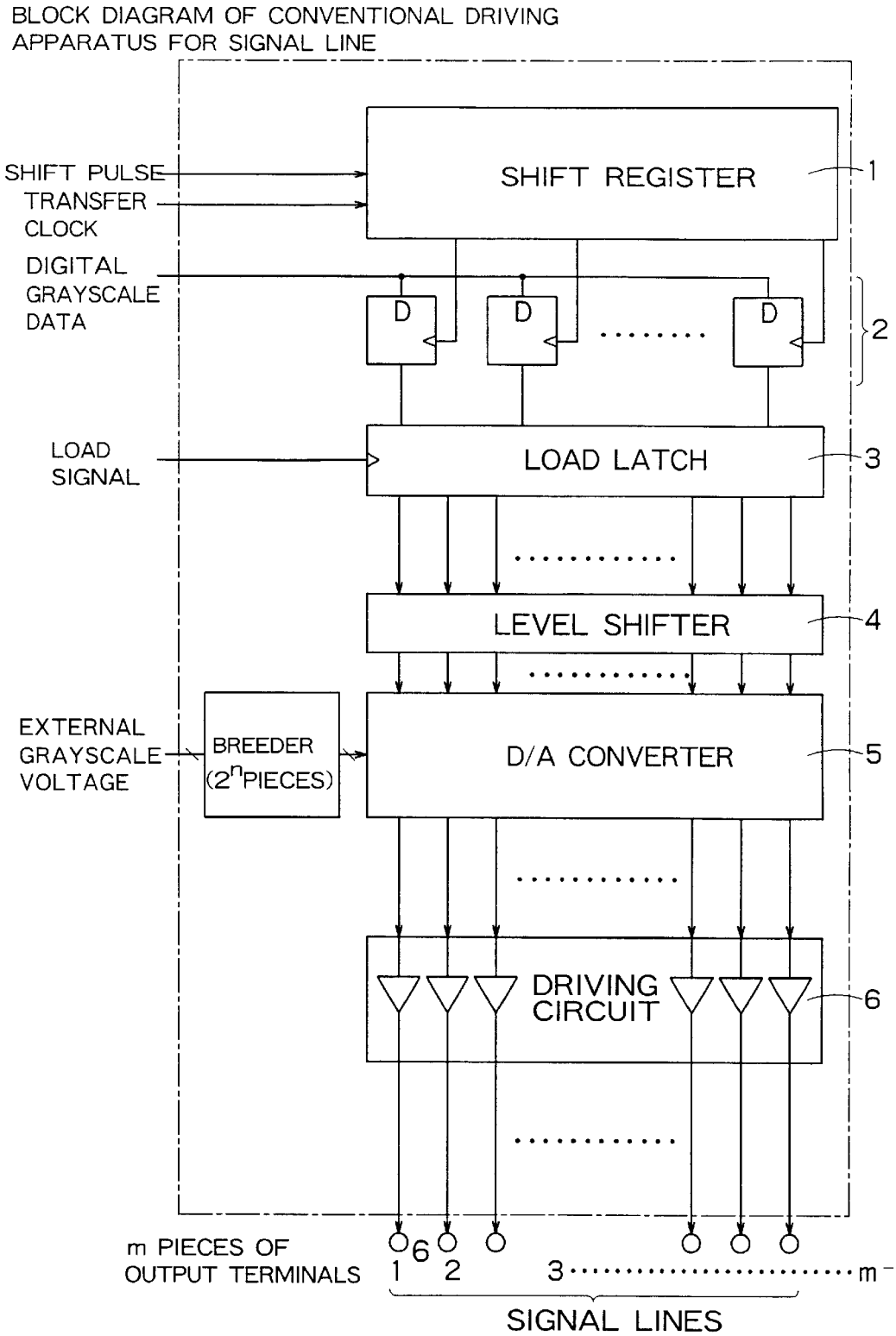
FIG. 11 PRIOR ART
FIG. 11 is a block diagram showing a schematic configuration of a conventional signal line driving circuit.
Figure 12:
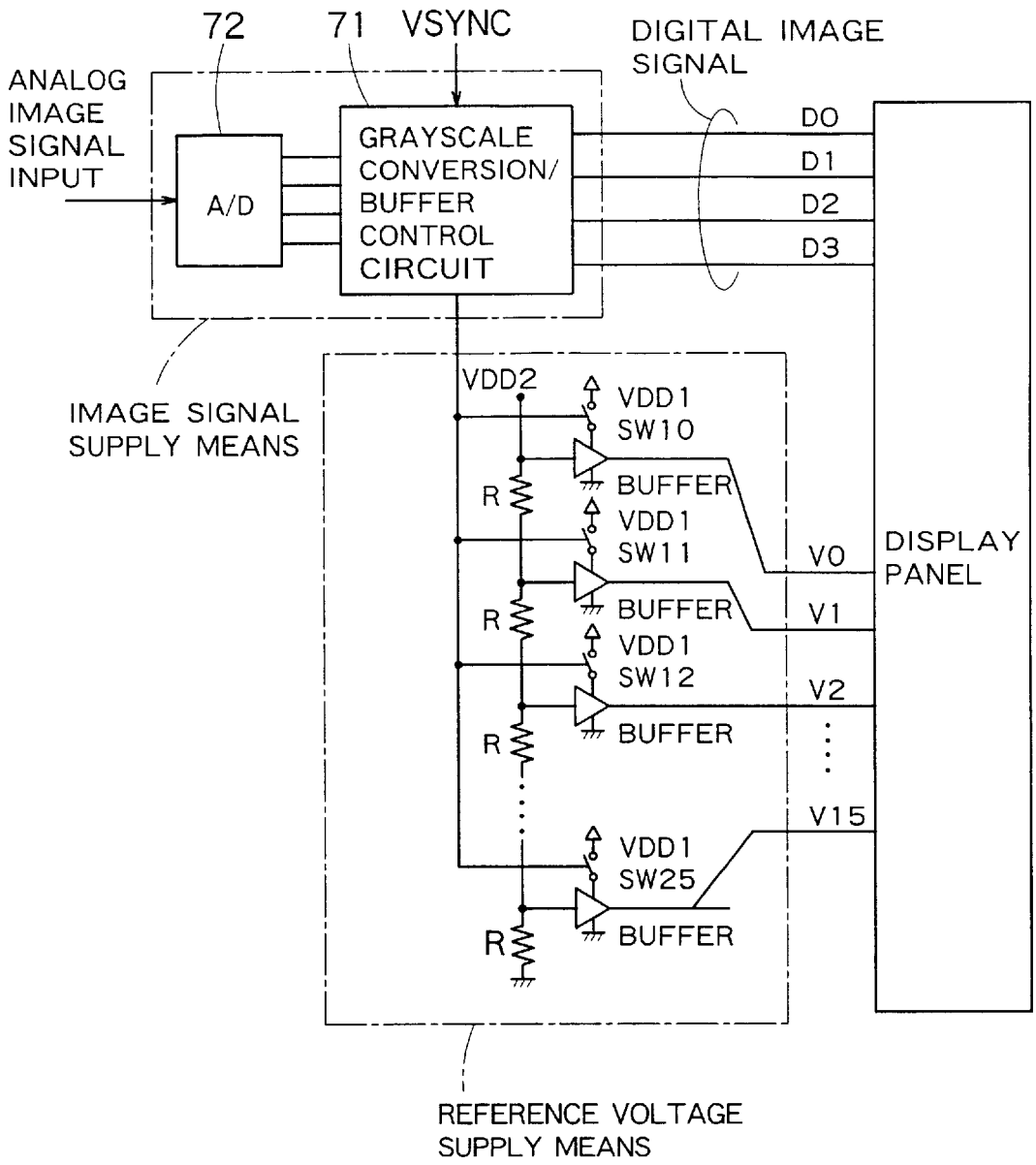
FIG. 12 PRIOR ART
FIG. 12 is a block diagram of a display disclosed in the buffer amplifier is disposed for each reference voltage line.

Similarly as FIG. 11, the liquid crystal driving circuit of FIG. 1 includes a shift register 1, a plurality of data latch circuits (first latch circuits) 2, a load latch circuit (second latch circuit) 3, a level shifter 4, a decoder 21, an output selection circuit 22, a breeder (reference voltage generation circuit) 7, and a buffer amplifier 6.

A D/A converter 5 is composed of the buffer amplifier 6, breeder 7, decoder 21 and output selection circuit 22.

Figure 2A:
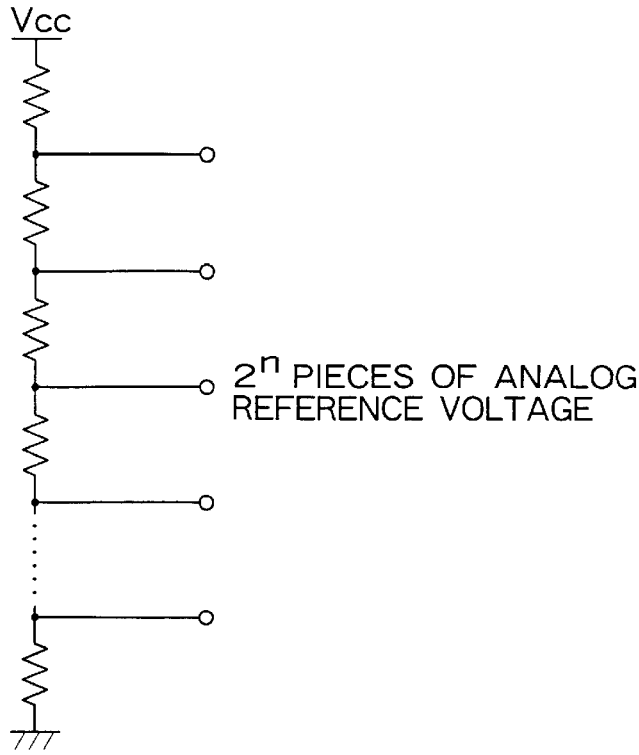
FIGS. 2A and 2B are circuit diagrams showing a detailed configuration of a breeder.
Figure 2B:
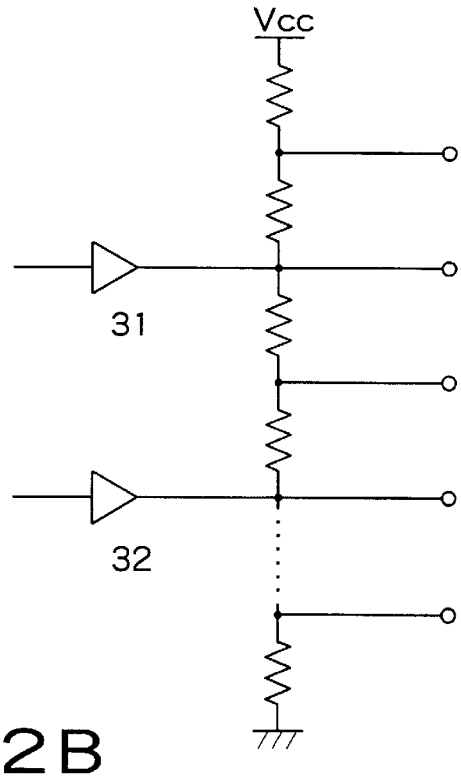

The breeder 7, for example, as shown in FIG. 2A, divides a voltage between two supply voltages (a power supply voltage and GND voltage) by a plurality of resistors to output an analog reference voltage. Alternatively, as shown in FIG. 2B, at least a part of analog reference voltage may be supplied from the outside via buffers 31 and 32 and so on.

Additionally, the liquid crystal driving circuit of FIG. 1 includes a grayscale data use judgment circuit 23 for checking grayscale inputted at least once or more based on the digital grayscale data inputted within a predetermined period, grayscale mode circuit 24 for controlling the data latch circuit 2 and so on based on a grayscale mode signal, and amplifier enable circuit 25.

Figure 3:
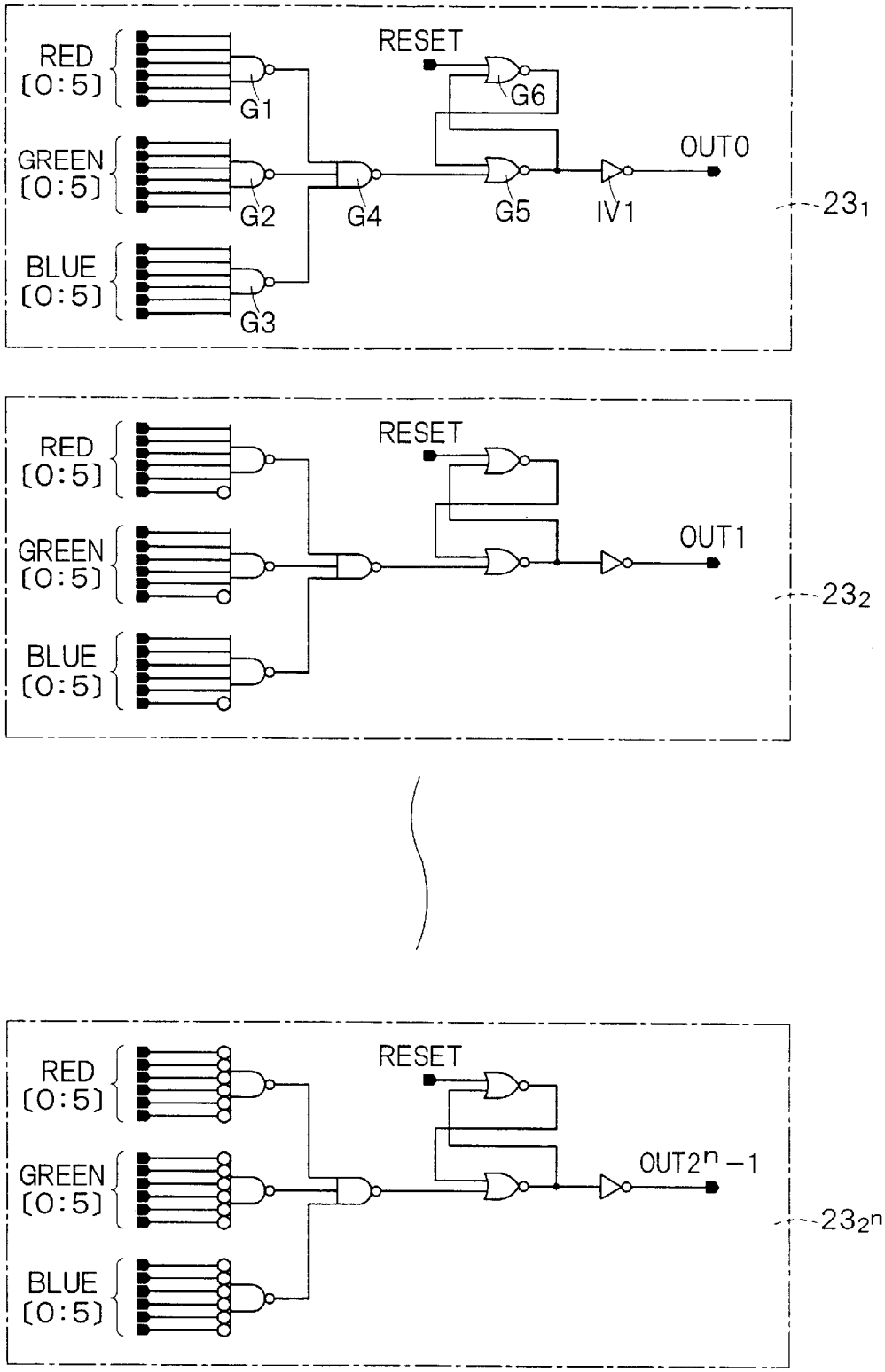
FIG. 3 is a circuit diagram showing a detailed configuration of a grayscale data use judgment circuit.

FIG. 3 is a circuit diagram showing a detailed configuration of the grayscale data use judgment circuit 23. As shown in FIG. 3, the grayscale data use judgment circuit 23 includes $2^6$=64 pieces of logic judgment circuits $\mathbf{23}_1$ to $\mathbf{23}_{64}$. Each of the logic judgment circuits $\mathbf{23}_1$ to $\mathbf{23}_{64}$ includes three 6-input NAND gates G1, G2, G3, a 3-input NAND gate G4, two NOR gates G5, G6, and an inverter IV1. An output of the 3-input NAND gate G4 is held by the NOR gates G5, G6.

The grayscale data use judgment circuits $\mathbf{23}_1$ to $\mathbf{23}_{64}$ output judgment signals $OUT_0$ to $OUT_{2^n-1}$ indicating that 6-bit digital grayscale data is equal to one of (0,0,0,0,0,0) to (1,1,1,1,1,1). RGB 6-bit signals RED[0:5], GREEN[0:5], BLUE[0:5] are inputted to the 6-input NAND gates, respectively. When at least one type of three types of 6-bit signals is (0,0,0,0,0,0), the output $OUT_0$ of the logic judgment circuit $\mathbf{23}_1$ is "1".

Similarly, when at least one type of RGB 6-bit digital grayscale data is (0,0,0,0,0,1), the output $OUT_1$ of the logic judgment circuit $\mathbf{23}_2$ is "1" Moreover, when at least one type of RGB 6-bit digital grayscale data is (1,1,1,1,1,1), the output $OUT_{63}$ of the logic judgment circuit $\mathbf{23}_{64}$ is "1".

The grayscale mode circuit 24 of FIG. 1 generates n-bit judgment signals $K_0$ to $K_{2^n-1}$ based on a grayscale mode signal supplied from the outside to determine a grayscale number. As one example of a grayscale mode, for example, the liquid crystal driving circuit for a cellular phone has a multi-grayscale mode of a time of usual use, and a low grayscale mode of a waiting time.

The outputs $K_0$ to $K_{2^n-1}$ of the grayscale mode circuit 24 are supplied to a plurality of data latch circuits 2 and amplifier enable circuit 25. Each of the data latch circuits 2 has respective latch sections for a maximum grayscale number, and each latch section is set to an enable state or disable state in accordance with the n-bit judgment signals $K_0$ to $K_{2^n-1}$ as the outputs of the grayscale mode circuit 24, that is, the grayscale number.

More specifically, as the grayscale number increases, the number of latch sections set to the enable state in the data latch circuit 2 increases. The a smaller grayscale number becomes, the number of latch sections set to the enable state in the data latch circuit 2 decreases. Therefore, when the grayscale number is small, the number of latch sections set to the enable state decreases, thereby reducing the power consumption.

Additionally, in FIG. 1, each data latch circuit 2 is shown by one block for simplicity, but practically, each shown block includes a plurality of latch sections.

Figure 4:
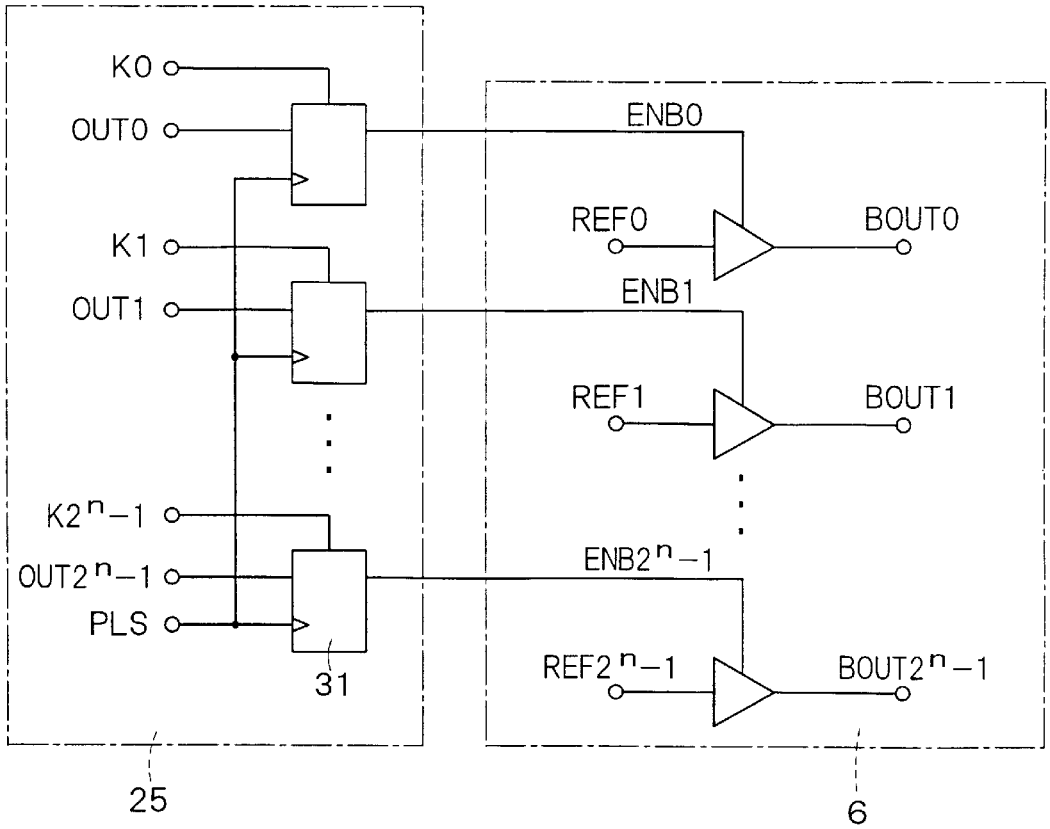
FIG. 4 is a circuit diagram showing a detailed configuration of an amplifier enable circuit.

As shown in a detail configuration of FIG. 4, the amplifier enable circuit 25 includes a plurality of flip-flops 31 which can latch respective outputs $OUT_0$ to $OUT_{2^n-1}$ of the grayscale data use judgment circuit 23. These flip-flops 31 latch the output of the grayscale data use judgment circuit 23 in synchronization with the shift pulse outputted from a final-stage register of the shift register 1. Additionally, instead of synchronization with the shift pulse outputted from the final-stage register of the shift register 1, a load signal inputted to the load latch circuit 3 may be utilized to generate a synchronization signal for latching the output of the grayscale data use judgment circuit 23.

Signals $K_0$ to $K_{2^n-1}$ are supplied to set or reset terminals of the respective flip-flops 31 from the grayscale mode circuit 24. By logic of the signals $K_0$ to $K_{2^n-1}$, the number of flip-flops 31 brought to the enable state changes in accordance with the grayscale number.

The flip-flop 31 in the enable state latches the corresponding output (any one of $OUT_0$ to $OUT_{2^n-1}$) of the grayscale data use judgment circuit 23 in synchronization with a clock PLS, and the latched output is supplied to an enable terminal of the corresponding buffer amplifier 6.

Additionally, when the grayscale number decreases, some bits of the digital grayscale data supplied to the grayscale data use judgment circuit 23 from the outside are fixed to a predetermined logic. Therefore, the grayscale data use judgment circuit 23 whose detailed configuration is shown in FIG. 3 can accurately judge the type of the digital grayscale data even in the low grayscale mode.

Concretely, the logic of some bits is fixed based on the output of the grayscale mode circuit 24 so that the output of the logic judgment circuit 23 corresponding to the flip-flop 31 brought to the disable state in FIG. 4 is "0" irrespective of the logic of the arbitrary bit.

Figure 5:
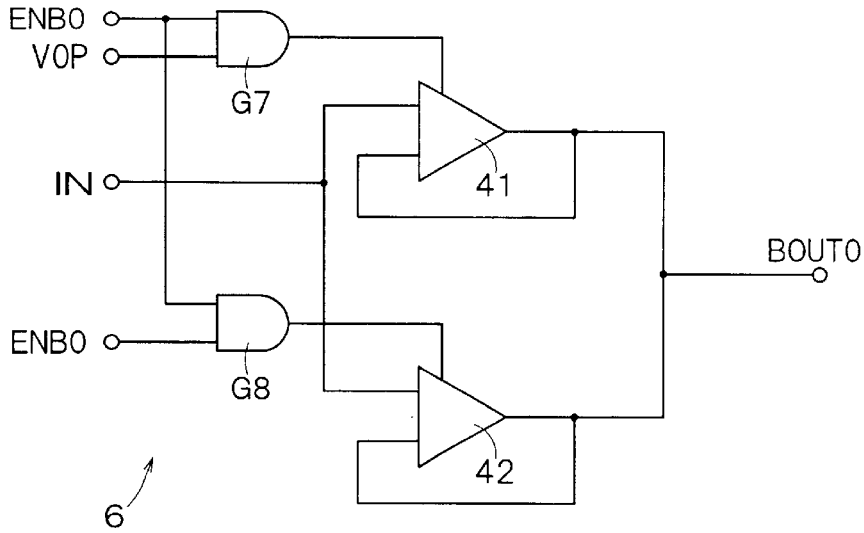
FIG. 5 is a circuit diagram showing a configuration of a buffer amplifier.

FIG. 5 is a circuit diagram showing an example of configuration of the buffer amplifier 6. As shown in FIG. 5, the buffer amplifier 6 is composed of connecting a first amplifier 41 for driving a high voltage side in parallel to a second amplifier 42 for driving a low voltage side. Both the first and second amplifiers 41, 42 have a voltage follower configuration in which the output is fed back to an input side.

Moreover, enable/disable state of the first and second amplifiers 41, 42 can be selected by AND gates G7, G8, that is, by the logic of an output ENB of the amplifier enable circuit 25 and polarity selection signals V0N, V0P. More specifically, when either one of the polarity selection signals V0N, V0P is set to a high level, only one of the first and second amplifiers 41, 42 can be operated.

Additionally, a reason why two amplifiers 41, 42 are disposed as shown in FIG. 5 is that a voltage range that one amplifier can output and the power consumption are reduced. However, the buffer amplifier 6 may be composed of only one amplifier.

In FIG. 5, a signal IN inputted to the first and second amplifiers 41, 42 is the same as $REF_0$ to $REF_{2^n-1}$ of FIG. 4, and is the analog reference voltage outputted from the breeder 7.

An operation of a liquid crystal display circuit of FIG. 1 will next be described. Additionally, the operation of a liquid crystal driving circuit incorporated in a driving IC (hereinafter referred to as a source driver) will be described.

Figure 6:
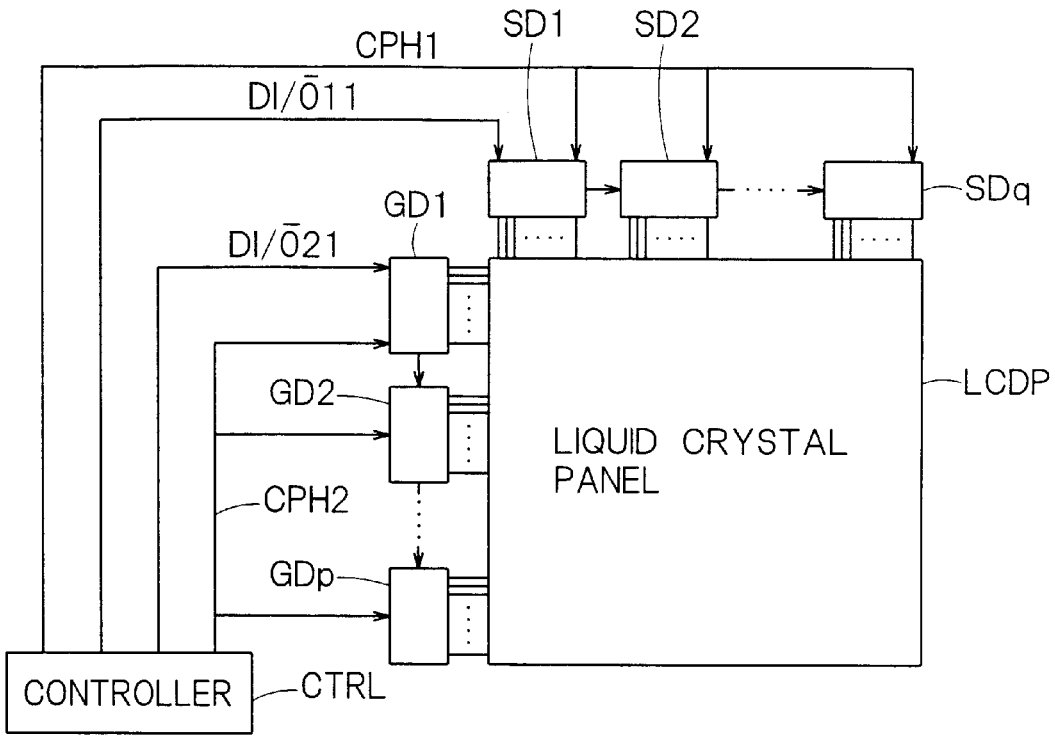
FIG. 6 is a block diagram showing a whole configuration of a liquid crystal display.

FIG. 6 is a block diagram showing a whole configuration of a liquid crystal display apparatus. In this example, a plurality of source drivers including the liquid crystal driving circuit of FIG. 1 are used to drive all signal lines of a liquid crystal panel. The liquid crystal display of FIG. 6 includes: a liquid crystal panel LCDP in which signal and scanning lines are arranged; a plurality of source drivers SD1 to SDq (q is an integer of 1 or more) for driving a plurality of signal lines, respectively; a plurality of gate drivers GD1 to GDp (p is an integer of 1 or more) for driving a plurality of scanning lines, respectively; and a controller CTRL for controlling the source drivers SD1 to SDq and gate drivers GD1 to GDp.

A clock CPH1 and input signal DI/O11 outputted from the controller CTRL are supplied to the source drivers SD1 to SDq, and the source drivers output voltage signals required for driving the signal lines of the liquid crystal panel LCDP. A clock CPH2 and input signal DI/021 outputted from the controller CTRL are supplied to the gate drivers GD1 to GDp, and the gate drivers output the voltage signals required for driving the gate lines of the liquid crystal panel LCDP. The source drivers SD1 to SDq drive some (hereinafter referred to as blocks) of the signal lines of a horizontal direction of the liquid crystal panel LCDP line by line.

The grayscale data use judgment circuit 23 of FIG. 1 distinguishes the type of the digital grayscale data supplied from the outside by the unit of m pieces of data which are inputted within the predetermined period and to be outputted to m pieces of output terminals, and supplies a signal for specifying the buffer amplifier 6 to be driven to the amplifier enable circuit 25.

As shown in FIG. 4, the amplifier enable circuit 25 supplies the signals $OUT_0$ to $OUT_{2^n-1}$ from the grayscale data use judgment circuit 23 to the buffer amplifier 6 in synchronization with the shift pulse outputted from the final-stage register in the shift register 1. Alternatively, the synchronization signal may be generated based on the load signal.

Therefore, only the buffer amplifier 6 associated with m pieces of digital grayscale data is brought to the enable state, thereby reducing the power consumption.

On the other hand, the grayscale mode circuit 24 determines the grayscale number based on the grayscale mode signal supplied from the outside. The n-bit judgment signals $K_0$ to $K_{2^n-1}$ from the grayscale mode circuit 24 are supplied to the amplifier enable circuit 25 and data latch circuit 2. The flip-flop in the amplifier enable circuit 25 and data latch circuit 2 is switched whether or not to become enable/disable state in response to the signal from the grayscale mode circuit 24.

As described above, in the present embodiment, the numbers of the flip-flops 31 in the amplifier enable circuit 25 and the latch sections of the data latch circuit 2 to be driven are changed in accordance with the grayscale number. For example, when the grayscale number is set to k bits ($1 \leqq k \leqq n-1$), the data latch circuit 2 allows only the latch sections of upper or lower k bits to operate in response to the signal from the grayscale mode circuit 24, and the corresponding flipflop 6 in the amplifier enable circuit 25 becomes enable state, so that every $2^{n-k}$-th buffer amplifier 6 at maximum becomes the enable state. Therefore, there is no possibility that power is consumed in unnecessary flip-flop and buffer amplifier, thereby reducing the power consumption.

The output of the buffer amplifier 6 is supplied to the output selection circuit 22. The output selection circuit 22 selects the output of the buffer amplifier 6 corresponding to the digital grayscale data, and supplies the selected analog voltage to the signal line. At this time, of the buffer amplifier 6 corresponding to the flip-flop 31 in the enable state in the amplifier enable circuit 25, the buffer amplifier 6 to which output "0" from the grayscale data use judgment circuit 23 is inputted is disabled regardless of m pieces of digital grayscale data, thereby further reducing the power consumption.

The above-mentioned amplifier enable circuit 25 controls whether or not to operate the buffer amplifier 6 based on both outputs of the grayscale data use judgment circuit 23 and grayscale mode circuit 24, but may control whether or not to operate the buffer amplifier 6 based on only the output of the grayscale mode circuit 24. In this case, the number of operating buffer amplifiers 6 increases and the power consumption increases as compared with the first embodiment, but an inner configuration of the amplifier enable circuit 25 is simplified.

Second Embodiment

In a second embodiment, a peripheral configuration of the buffer amplifier 6 is devised to shorten a settling time.

Since the second embodiment is similar to the first embodiment except the peripheral configuration of the buffer amplifier 6, description is omitted.

Figure 7:
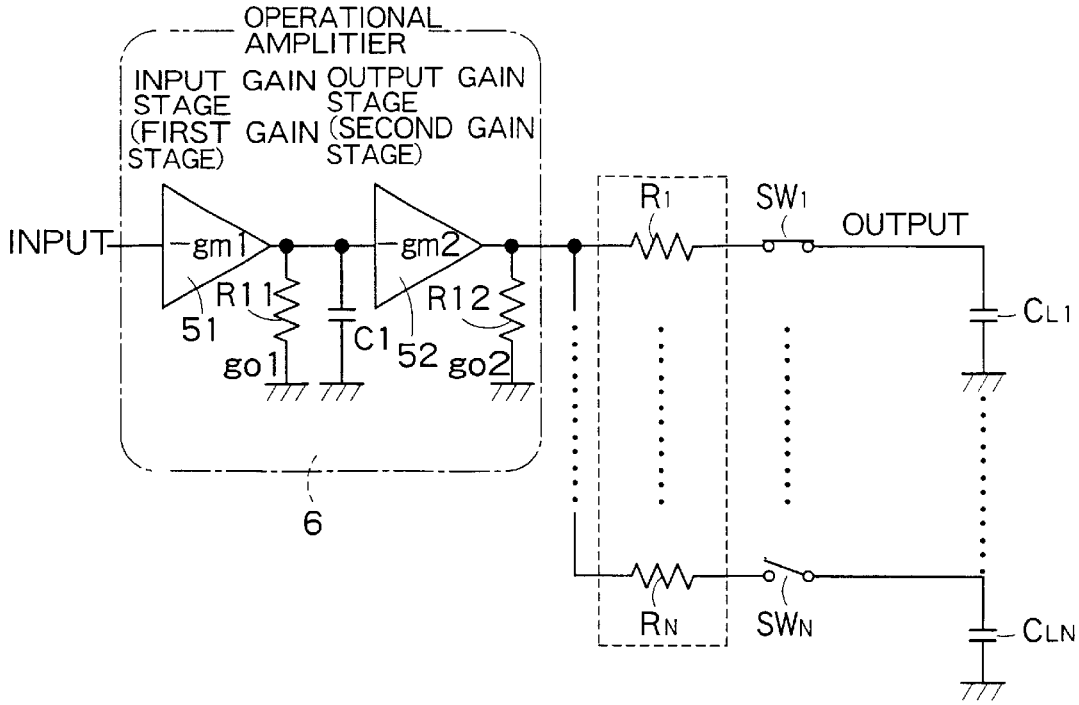
FIG. 7 is a circuit diagram showing a peripheral configuration of the buffer amplifier.

FIG. 7 is a circuit diagram showing the peripheral configuration of the buffer amplifier 6. Additionally, when the buffer amplifier 6 is composed of the first and second gain stages 41, 42 as shown in FIG. 5, each of the first and second gain stages 41, 42 is constituted as shown in FIG. 7.

The buffer amplifier 6 of FIG. 7 includes an operational amplifier constituted of two gain stages 51, 52, and resistors $R_1$ to $R_N$ and switches $SW_1$ to $SW_N$ are connected in series between the output terminal of the second gain stage (output gain stage) 52 and respective loads.

The switches $SW_1$ to $SW_N$ correspond to analog switches (not shown) in the output selection circuit 22, and the resistors $R_1$ to $R_N$ are connected between the buffer amplifier 6 of FIG. 1 and the output selection circuit 22. Load capacities $CL_1$ to $CL_N$ are load capacitances of the signal line, and the load capacitance is a combination of a capacitance of a pixel TFT itself connected to the signal line, liquid crystal capacitance, auxiliary capacitance, and the like.

The switches $SW_1$ to $SW_N$ change the number of loads, and at least one of the switches $SW_1$ to $SW_N$ is turned on. When the load is not connected, the corresponding switches $SW_1$ to $SW_N$ are turned off. Therefore, the buffer amplifier 6 is not influenced by the load capacitance of the corresponding path.

In the following, it is assumed that transconductances of the gain stages 51, 52 in the buffer amplifier 6 are (−gm1), (−gm2), an output conductance of the forward-side gain stage (input gain stage) is go1, the output conductance of the first gain stage is go2, and load capacitances of the respective loads are $C_{L1}, C_{L2}, \ldots, C_{LN}$.

Figure 8:
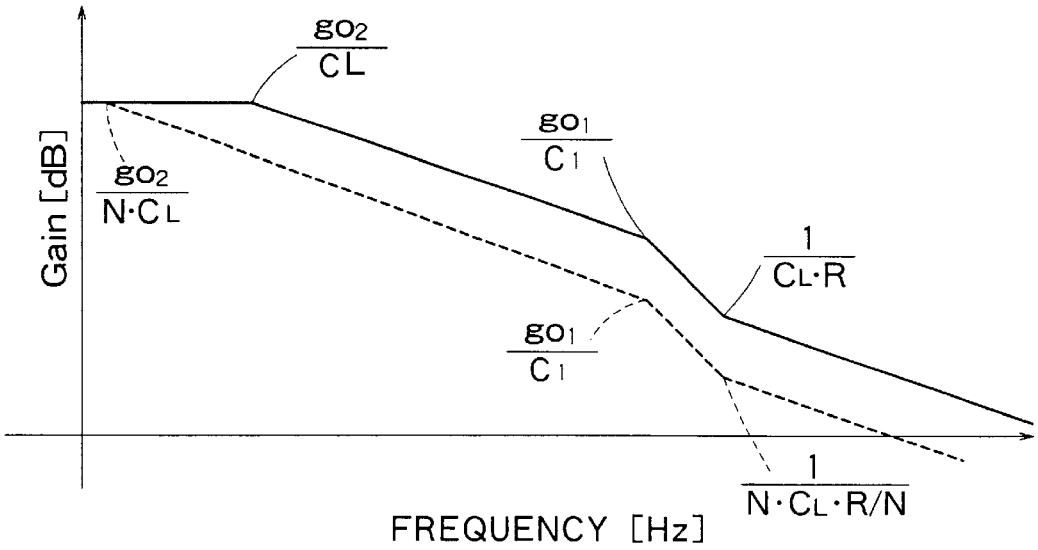
FIG. 8 is a frequency characteristic diagram of the buffer amplifier of FIG. 7.

FIG. 8 is a frequency characteristic diagram of the buffer amplifier 6 of FIG. 7. In FIG. 8, a solid line shows a characteristic with only one load, and a dotted line shows the characteristic with N loads. As shown in FIG. 8, a frequency of a first pole in an open loop frequency characteristic with only one load is $go2/C_L$, the frequency of a second pole is $go1/C_1$, and the frequency of a zero is $1/(N \cdot C_L \cdot R)$.

Moreover, the frequency of the first pole with N loads is $go2/(N \cdot C_L)$, the frequency of the second pole is $go1/C_1$, and the frequency of the zero is $1/(N \cdot C_L \cdot R/N)$.

When the load is N times, the load capacitance is also N times in this manner. However, since the buffer amplifier 6 of FIG. 7 is provided with the resistors $R_1$ to $R_N$ for the respective loads, impedance is 1/N times. As a result, even when the number of the load is changed, a time constant always indicates a constant value $C_L \cdot R$. The frequency of the zero is always constant irrespective of the number of the loads.

Figure 13A:
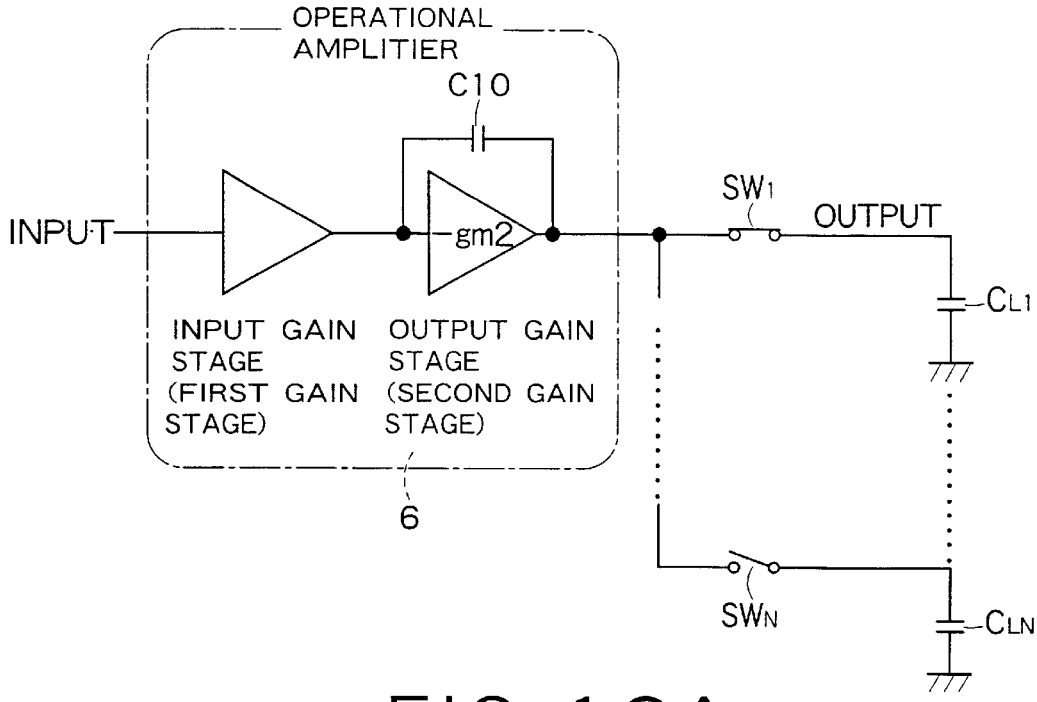
FIGS. 13A and 13B show a circuit diagram of a periphery of a conventional buffer amplifier and a frequency characteristic diagram.
Figure 13B:
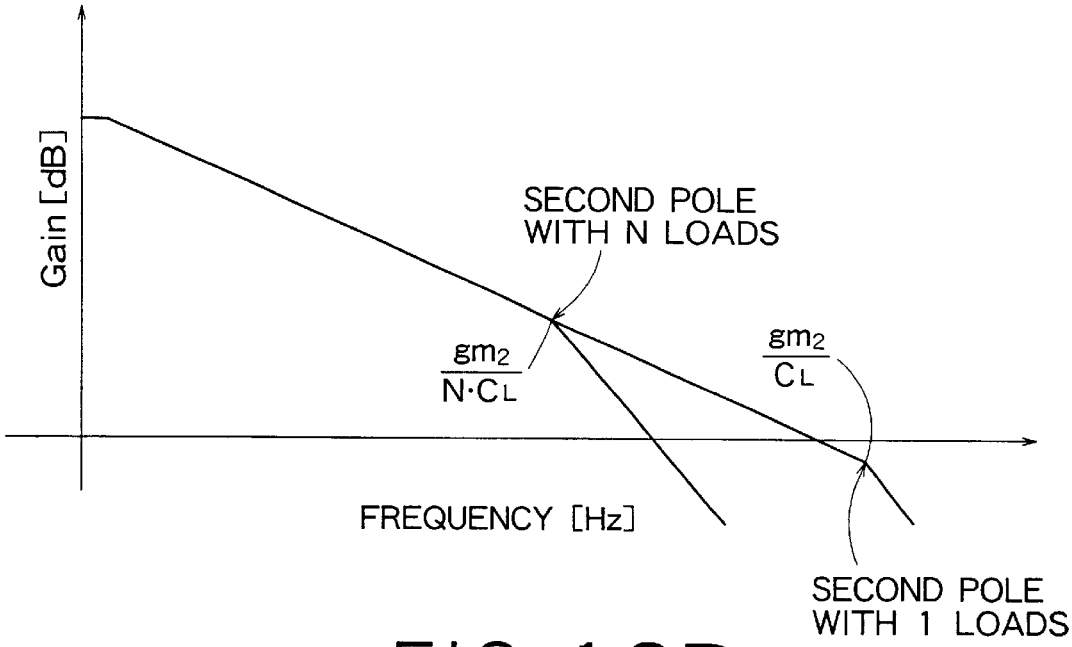
FIG. 13B PRIOR ART

Moreover, since the frequency of the second pole does not change, more phase margin is secured as compared with the conventional buffer amplifier as shown in FIG. 13.

Figure 14A:
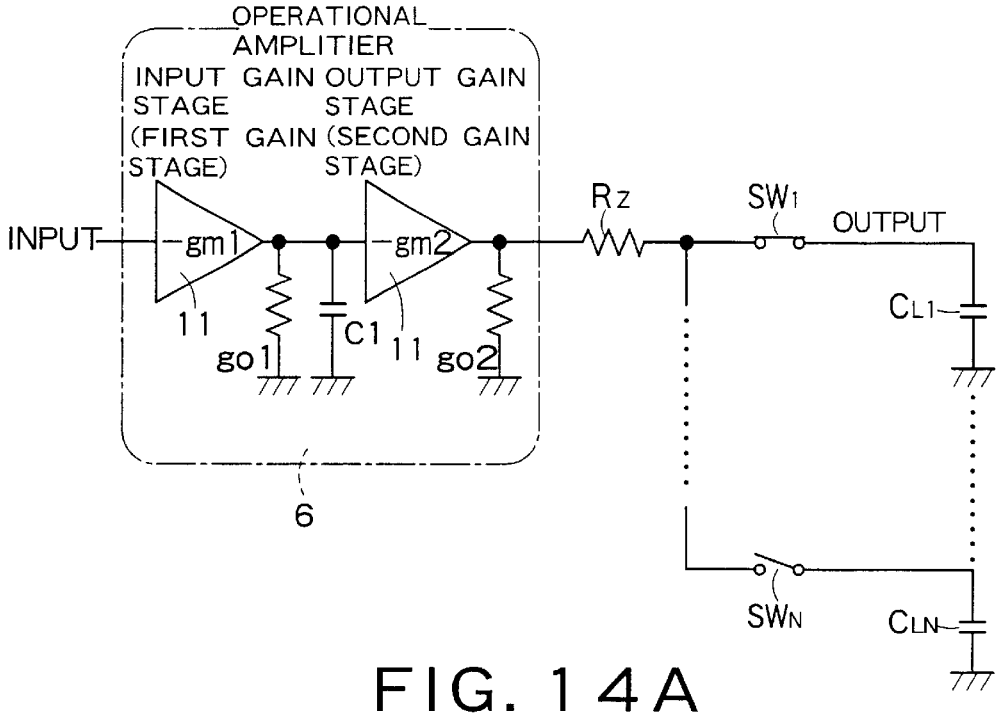
FIGS. 14A and 14B show a circuit diagram of the periphery of the conventional buffer amplifier and the frequency characteristic diagram.
Figure 14B:
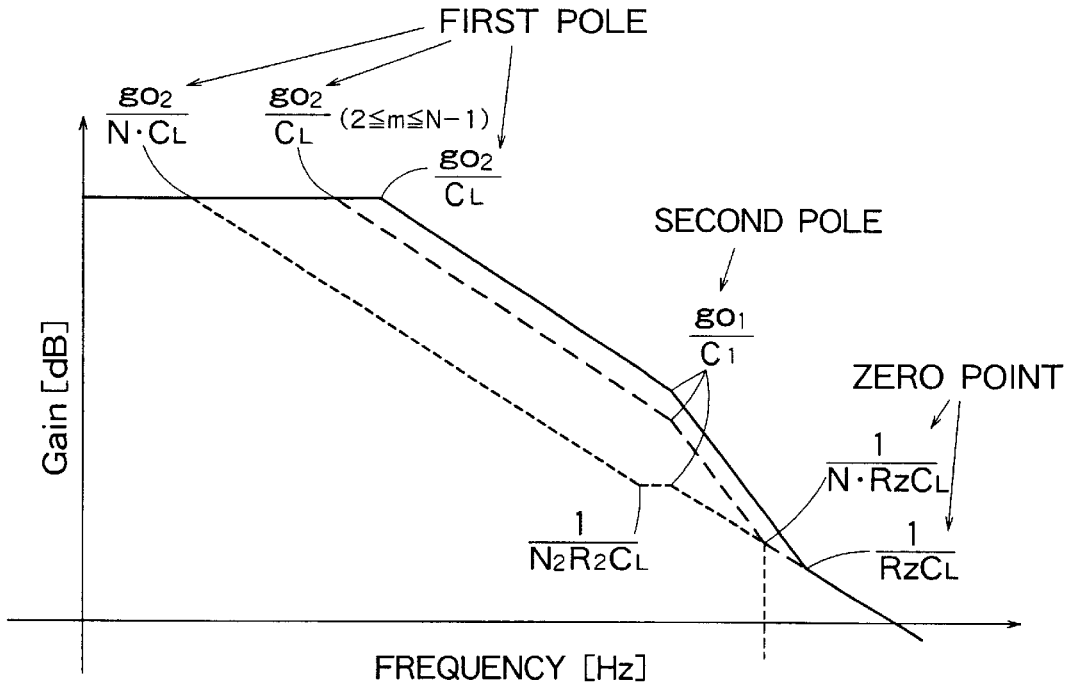
FIG. 14B PRIOR ART

As compared the buffer amplifier 6 of the second embodiment with the conventional buffer amplifier 6 shown in FIG. 14A, the conventional buffer amplifier has a problem that with an increase of the load capacitance, the time constant determined by a resistance Rz and load capacitance increases, thereby making the waveform dull and lengthening the settling time. On the other hand, in the second embodiment, even when the number of the loads is changed, the time constant is constant. Therefore, there is no likelihood that the waveform becomes duller and the settling time becomes longer due to the register Rz and the load capacitance.

Additionally, in FIG. 7, the resistors $R_1$ to $R_N$ are connected between the output terminal of the buffer amplifier 6 and the switches $SW_1$ to $SW_N$. However, the resistors $R_1$ to $R_N$ may be connected between the switches $SW_1$ to $SW_N$ and the load.

Third Embodiment

In a third embodiment, a dummy load circuit is added to the buffer amplifier 6 of the second embodiment.

Figure 9:
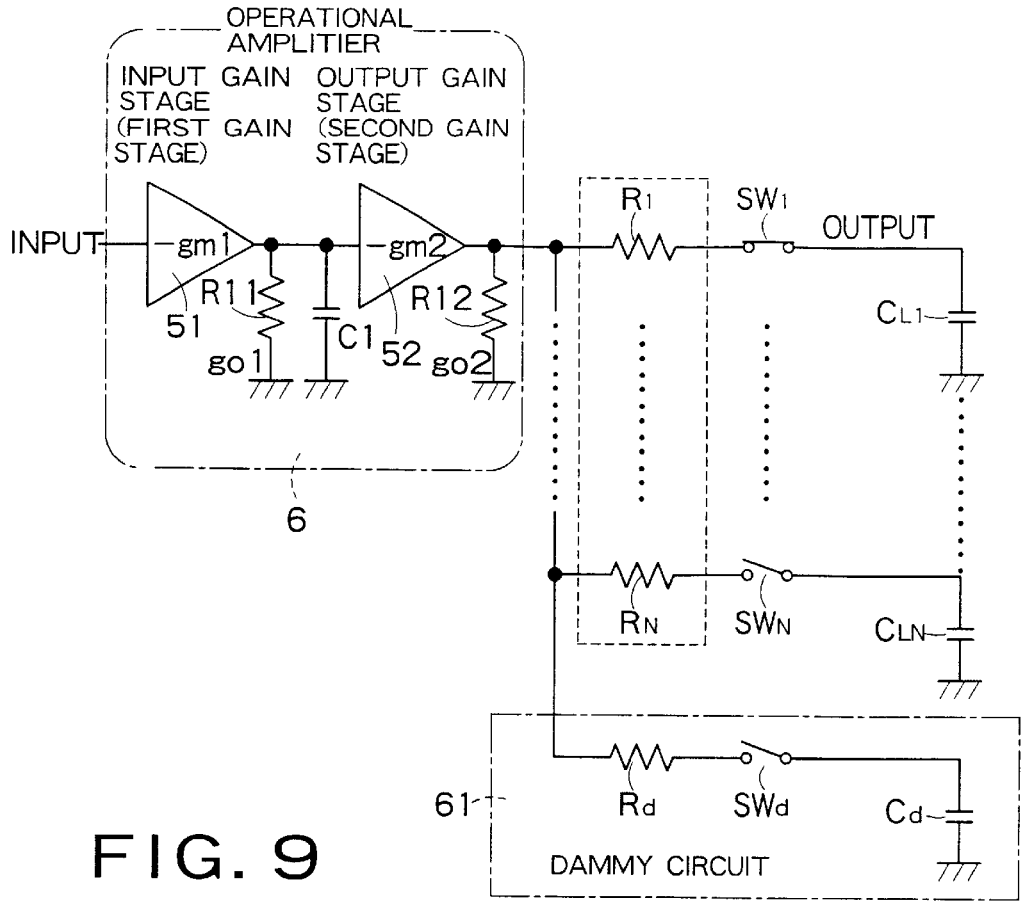
FIG. 9 is a circuit diagram showing a peripheral configuration of the buffer amplifier of a third embodiment.

FIG. 9 is a circuit diagram showing the peripheral configuration of the buffer amplifier 6 of the third embodiment. In the configuration, a dummy load circuit 61 is added to the output terminal of the output gain stage 52 of FIG. 7. The dummy load circuit 61 is composed of connecting a resistor Rd, switch SWd and capacitor Cd in series.

The second embodiment is on the assumption that at least one of the switches $SW_1$ to $SW_N$ connected to the load is turned on. However, when all the switches $SW_1$ to $SW_N$ are turned off, the operation of the buffer amplifier 6 becomes unstable, and oscillation possibly occurs.

On the other hand, the buffer amplifier 6 of FIG. 9 turns on the switch SWd in the dummy load circuit 61, when all the switches $SW_1$ to $SW_N$ connected to the load are turned off. If the time constant of the resistor Rd and capacitor Cd in the dummy load circuit 61 is set to be almost equal to the time constant of the load capacities $C_{Li}$(i=1–N) and resistors $R_i$(i=1–N), the buffer amplifier 6 stably operates in both the case that it drives the load except for the dummy load circuit 61 and the case that it drives the dummy load circuit 61.

As described above, according to the third embodiment, even when all the switches $SW_1$ to $SW_N$ are turned off, a steady operation is assured by turning on the switch SWd in the dummy load circuit 61.

Fourth Embodiment

In a fourth embodiment, a common resistor is connected between the output of the buffer amplifier 6 and the resistors $R_1$ to $R_N$.

Figure 10:
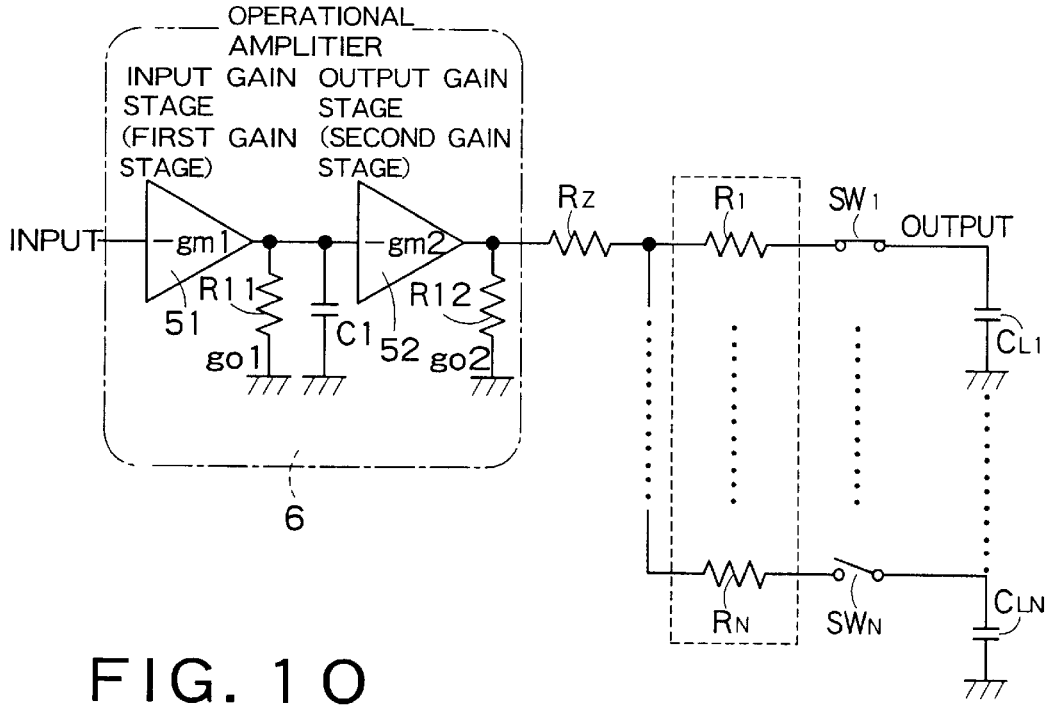
FIG. 10 is a circuit diagram showing a peripheral configuration of the buffer amplifier of a fourth embodiment.

FIG. 10 is a circuit diagram showing the peripheral configuration of the buffer amplifier 6 of the fourth embodiment. One end of a common resistor Rz is connected to the output terminal of the buffer amplifier 6, and the other end thereof is connected to the resistors $R_1$ to $R_N$. The common resistor Rz has a value which is smaller than a sum of on-resistance values of the switches $SW_i$(i=1–N) and resistance values of the resistors $R_i$(i=1–N) connected to the switches $SW_i$(i=1–N). The common resistor preferably has a resistance value smaller than the on-resistance value of the switches $SW_i$(i=1–N).

Since the common resistor Rz is disposed, in the frequency characteristic diagram of FIG. 8, the frequency of the zero can slightly be lowered, and a frequency difference between the frequency of the second pole and the frequency of the zero can be reduced, thereby enlarging the phase margin when a gain is "1" and realizing more stable operation.

Additionally, when the resistance value of the common resistor Rz is excessively large, as shown in the circuit of FIG. 14A, the waveform becomes dull and the settling time become long. Therefore, the resistance value of the common resistor Rz is preferably set to be small as described above.

FIG. 10 shows an example in which the common resistor Rz is added to the configuration of FIG. 7. The common resistor Rz may be added to FIG. 9.

What is claimed is:

1. A liquid crystal driving circuit configured to supply an analog voltage in accordance with digital grayscale data to each of a plurality of signal lines, said circuit comprising:

a reference voltage generation circuit configured to output an analog reference voltage corresponding to each of said digital grayscale data;

a plurality of buffer amplifiers configured to individually perform buffering of said respective analog reference voltages;

a grayscale mode circuit configured to determine a grayscale number of said digital grayscale data based on a grayscale mode signal supplied from the outside; and an amplifier enable circuit configured to set each of said plurality of buffer amplifiers to an enable state or a disable state based on an output signal of said grayscale mode circuit.

2. The liquid crystal driving circuit according to claim 1, further comprising:

a shift register configured to output a shift pulse obtained by successively shifting a pulse signal;

a plurality of first latch circuits configured to latch said digital grayscale data in synchronization with the shift pulse outputted from each output terminal of said shift register;

a second latch circuit configured to latch respective outputs of said plurality of first latch circuits at the same timing;

a decoder configured to generate a decode signal based on an output of said second latch circuit; and an output selection circuit configured to select any one of outputs of said plurality of buffer amplifiers for each of said plurality of signal lines, wherein each of said first latch circuits comprises at least latch sections corresponding to a maximum grayscale number, and the number of said latch sections brought to an enable state is set to be variable based on an output signal of said grayscale mode circuit.

3. The liquid crystal driving circuit according to claim 2 wherein either a signal indicating a first operation mode or a signal indicating a second operation mode whose grayscale number is smaller than that of said first operation mode is inputted as said grayscale mode signal to said grayscale mode circuit, and said grayscale mode circuit is controlled so that the number of said latch sections and said buffer amplifier set to the enable state at said second operation mode is less than that of said first operation mode.

4. The liquid crystal driving circuit according to claim 1, further comprising:

a grayscale data use judgment circuit configured to check grayscale inputted at least once or more based on said digital grayscale data inputted within a prescribed period, wherein said amplifier enable circuit sets each of said plurality of buffer amplifiers to the enable state or the disable state based on outputs of said grayscale mode circuit and said grayscale data use judgment circuit.

5. A liquid crystal driving circuit configured to supply an analog voltage in accordance with digital grayscale data to each of a plurality of signal lines, said circuit comprising:

a reference voltage generation circuit configured to output analog reference voltages corresponding to each of said digital grayscale data;

a shift register configured to output a shift pulse obtained by successively shifting a pulse signal;

a plurality of first latch circuits configured to latch said digital grayscale data in synchronization with the shift pulse outputted from each output terminal of said shift register;

a second latch circuit configured to latch respective outputs of said plurality of first latch circuits substantially at the same timing;

a decoder configured to generate a decode signal based on an output of said second latch circuit;

an output selection circuit configured to output a desired analog voltage for each of said plurality of signal lines based on an output of said decoder; and a grayscale mode circuit configured to determine a grayscale number of said digital grayscale data based on a grayscale mode signal supplied from the outside, wherein each of said first latch circuits comprises at least latch sections corresponding to a maximum grayscale number, and the number of said latch sections brought to an enable state is set to be variable based on an output signal of said grayscale mode signal.

6. The liquid crystal driving circuit according to claim 5, further comprising:

a plurality of buffer amplifiers configured to individually perform buffering of said respective analog reference voltages; and an amplifier enable circuit configured to set each of said plurality of buffer amplifiers to an enable state or a disable state based on an output signal of said grayscale mode circuit, wherein either a signal indicating a first operation mode or a signal indicating a second operation mode whose grayscale number is smaller than that of said first operation mode is inputted as said grayscale mode signal to said grayscale mode circuit, and said grayscale mode circuit is controlled so that the number of said latch sections and said buffer amplifier set to the enable state at said second operation mode is less than that of said first operation mode.

7. The liquid crystal driving circuit according to claim 6, further comprising:

a grayscale data use judgment circuit configured to output a signal indicating a type of said digital grayscale data inputted in a predetermined period, wherein said amplifier enable circuit sets each of said plurality of buffer amplifiers to the enable state or the disable state based on outputs of said grayscale mode circuit and said grayscale data use judgment circuit.

* * * * *